United States Patent [19]

Berry

[11] 4,377,737

[45] Mar. 22, 1983

[54] ELECTRICALLY HEATED STEAM BOILER FOR GENERATING SUPERHEATED STEAM

[76] Inventor: Clyde F. Berry, R.F.D. 7, Box 169 C, Manchester, N.H. 03104

[21] Appl. No.: 229,867

[22] Filed: Jan. 30, 1981

[51] Int. Cl.[3] ..... F24H 1/20; F22B 1/28; H05B 3/78

[52] U.S. Cl. ..... 219/275; 122/4 A; 122/33; 122/41; 165/104.26; 219/326; 219/341

[58] Field of Search ..... 219/271–276, 219/326, 341; 122/33, 41, 4 A; 165/104.26

[56] References Cited

U.S. PATENT DOCUMENTS

| | | | |
|---|---|---|---|
| 994,805 | 6/1911 | Wallerstein | 122/41 |
| 1,376,509 | 5/1921 | Borst | 219/275 X |
| 1,441,610 | 1/1923 | Topp | 219/326 X |
| 2,835,480 | 5/1958 | Perez | 219/326 X |
| 3,637,979 | 1/1972 | Moeglich | 219/271 |
| 3,949,565 | 4/1976 | Roop | 122/33 X |

FOREIGN PATENT DOCUMENTS

| | | | |
|---|---|---|---|
| 1811250 | 6/1970 | Fed. Rep. of Germany | 219/326 |
| 1237897 | 6/1960 | France | 219/271 |
| 54-100549 | 8/1979 | Japan | 219/326 |
| 54-127057 | 10/1979 | Japan | 219/341 |

*Primary Examiner*—A. Bartis

*Attorney, Agent, or Firm*—C. Yardley Chittick

[57] ABSTRACT

A steam boiler for producing superheated steam directly in the boiler from saturated steam being generated therein includes a plurality of vertical sealed high pressure boiler water heating tubes, each provided with an electrical heating element and containing a limited quantity of water, mounted in a boiler water filled well in the bottom wall of the boiler. Energization of the heating element of each sealed tube produces high pressure saturated steam in the tube causing the tube to rise in temperature to generate saturated steam in the boiler from the water in the well. The tubes each have a vertical extent substantially greater than the controlled depth of water in the boiler. The saturated boiler steam is superheated by an elongated, sealed, vertical vessel mounted on the bottom wall of the boiler and extending upwardly into the boiler steam space above the upper ends of the heating tubes. The vessel contains an electric heater and a limited quantity of water for producing high pressure steam therein at a temperature well above the temperature of the saturated steam in the boiler when the heater is energized, whereby heat radiated from the surface of the vessel causes the surrounding saturated boiler steam to be superheated prior to discharge from the boiler.

3 Claims, 5 Drawing Figures

ELECTRICALLY HEATED STEAM BOILER FOR GENERATING SUPERHEATED STEAM

BACKGROUND OF THE INVENTION

The benefits derived from the use of superheated steam for driving steam englines, turbines, for heating and other purposes are well understood in the art. The conventional methods of creating superheated steam involve generating saturated steam in a boiler, then passing the saturated steam from the boiler through a pipe which have been heated to a high temperature. The temperature of the saturated steam passing through the pipes is raised to place the moving steam in superheated condition for immediate use as it leaves the superheater. The superheated steam is not created in the boiler prior to discharge therefrom but rather as it moves through hot piping after leaving the boiler in saturated condition.

SUMMARY OF THE PRESENT INVENTION

The present invention is designed to produce superheated steam directly in the boiler from the saturated steam being generated therein. Since the pressure of the superheated steam in the boiler is no greater than the pressure of the saturated steam originally generated, any boiler capable of meeting the required saturated steam pressure conditions can be used.

The superheating is achieved through the use of a novel self-contained unit located in a suitable position in the boiler which unit creates a heat above that of the surrounding saturated steam.

The higher heat of the unit is radiated to the saturated steam, raising the temperature of the steam to put it in superheated condition. Thus the boiler contains continuously produced superheated steam ready to be piped under valve control to the point of use.

DESCRIPTION OF A PREFERRED EMBODIMENT

Figure 1:
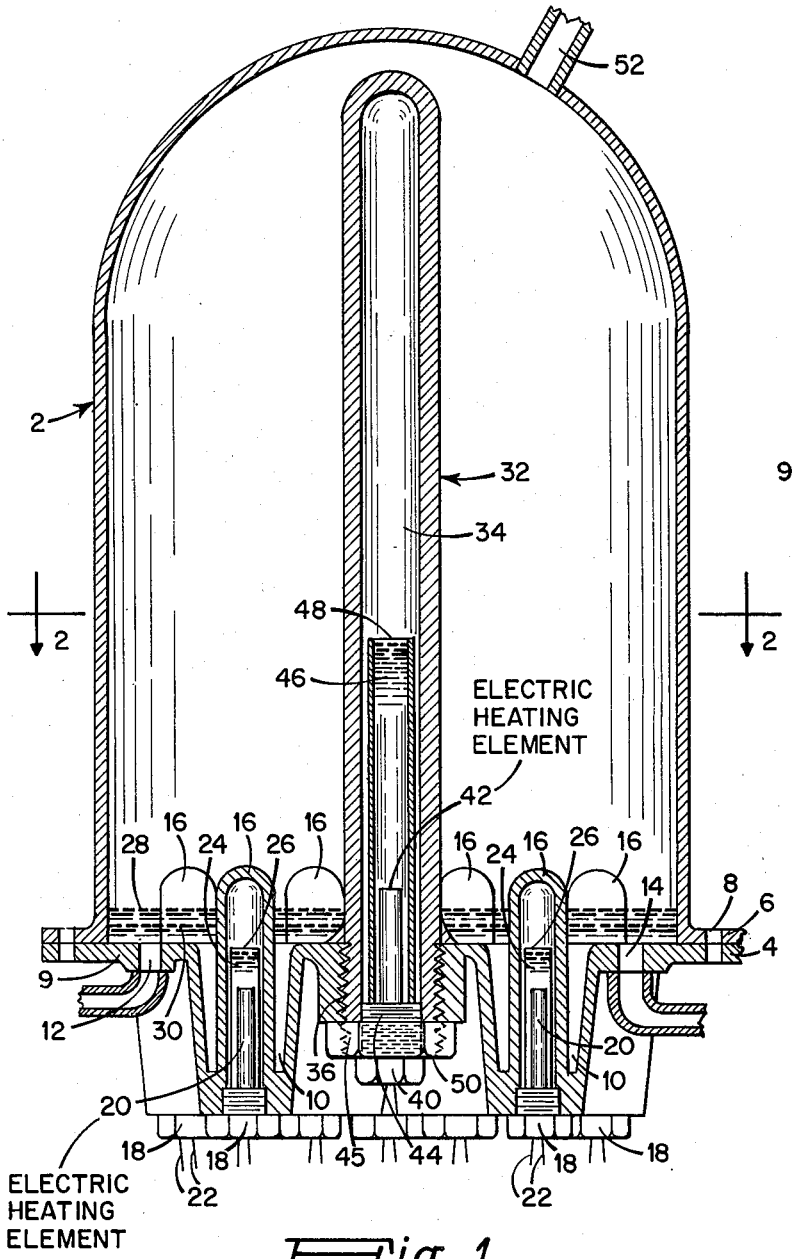
FIG. 1 is a vertical section of one form of the invention.
Figure 3:
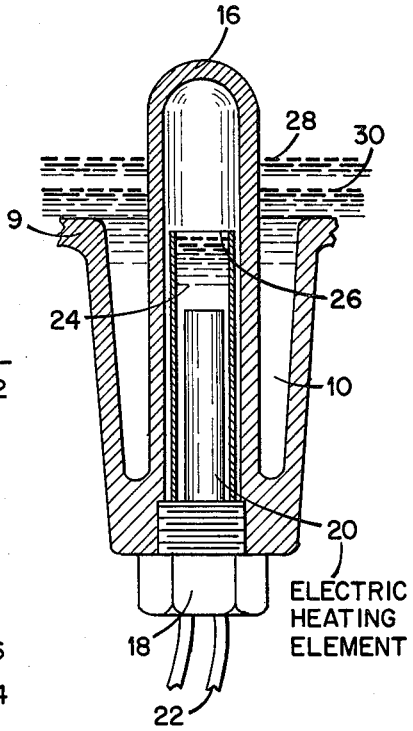
FIG. 3 is an enlarged detail in vertical similar to the part shown in FIG. 1 and taken on the line 3—3 of FIG. 2.
Figure 2:
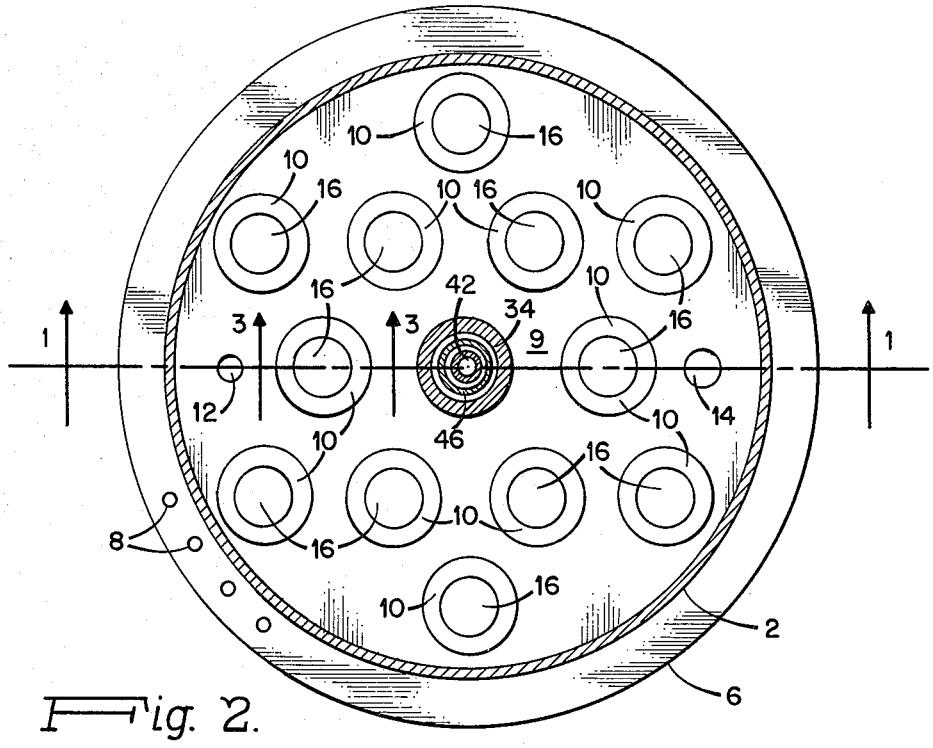
FIG. 2 is a horizontal section taken on the line 2—2 of FIG. 1.

Referring first to FIGS. 1, 2 and 3 there is shown a steam boiler at 2. This boiler may be of any size and shape determined by the user's requirements. In the present disclosure the boile is cylindrical and rests on a foundation ring 4 sized to receive the flanged bottom 6 of the boiler. The parts are secured together in water tight relation by cap screws (not shown) positioned in threaded holes 8.

Interiorly of the ring 4 is an integral base portion 9 which contains a number of water wells 10 of which twelve are shown in FIG. 2. Two are in section in FIG. 1, and one is shown in enlarged section in FIG. 3.

Water is fed to the boiler through inlet 12 by valved piping (not shown). The boiler drain is at 14, normally closed by a valve (not shown).

Extending vertically from the bottom of each well 10 is a steam generating tube 16. These tubes as shown are of strong metal, closed at the top and closed at the bottom by a threaded plug 18 which carries a cartridge type electric heater element 20. Wires 22 lead from each element 20 through plug 18 in water tight manner to any convenient source of electric power such as a 120 volt wall outlet. The number and wattage of elements 20 is a matter of choice according to the desired rate of steam generation in the boiler.

Each plug 18 also carries a cylindrical water sleeve 24 open at its upper end which surrounds element 20 in spaced relation and is sized to fit in easy sliding relation within tube 16. The upper end of sleeve 24 is at 26. The lower end of sleeve 24 is affixed to plug 18 in water tight relation. By the use of sleeve 24, a measured quantity of water may be placed within each tube when the nut and associated heating element is screwed into place. With the plug 18 in place the tube 16 is a completely sealed unit partially filled with water ready to be turned to steam by heat from element 20.

The water level in the boiler is automatically controlled with the high level at 28 and the low level at 30. There is nothing critical about the water level but preferably the volume of water will be relatively small to hasten the production of steam.

In the center of the base 9 is a sealed vessel 32 which serves as a superheater to provide the heat necessary to raise the temperature of the originally generated saturated steam in the boiler to superheated condition.

The construction of vessel 32 is as follows. A long strong metallic tube 34 is closed at its upper end and threaded at its lower end into base 9 at 36. A plug 40 carrying an electric heating element 42 is screw threaded into the lower end of tube 34 as at 44 through lock nut 45.

Plug 40 also carries a water sleeve 46 having its open upper end at 48 and its lower end surrounding element 42 and sealed to the top of plug 40. Sleeve 46 makes a good sliding fit with the interior of tube 34.

In assembling vessel 32, the sleeve 46 is filled with water and then inserted upwardly into tube 34 after which plug 40 is screwed into place to seal the bottom end of the tube.

The vessel 32 is then a sealed unit containing a measured quantity of water and a heating element which is activated by current through wires 50 passing through plug 40 in water tight relation.

The operation of the boiler and superheater is as follows. Current is applied to some or all of the heating elements 20 in tubes 16. The small amount of water in each tube 16 is quickly converted to steam with the temperature of the steam and the tubes 16 rising to a predetermined degree well above the boiling point of water.

The high temperature of tubes 16 is then transmitted to the boiler water which is promptly turned into saturated steam to fill boiler 2. Pressure and/or temperature controls in boiler 2 acting to energize or deenergize elements 20 function automatically to maintain the boiler steam pressure within a predetermined range.

At the same time that the heating elements 20 are turned on, element 42 in the vessel 32 is activated. This promptly generates saturated steam in the vessel with the pressure and temperature continuously rising to a predetermined degree where it is maintained by a temperature control (not shown) activated by the wall temperature of tube 34 to energize or deenergize element 42.

The temperature of tube 34 is set to produce superheated steam of the temperature required. The superheating occurs by the radiation of high temperature heat from tube 34 to the surrounding saturated steam produced from the boiler water by the heating tubes 16.

The construction disclosed herein provides the novel result of creating and storing superheated steam in a boiler awaiting a call for use and alternatively of creating superheated steam fast enough within the boiler to meet the use requirements continuously.

It will be understood that since the tubes 16 and the vessel 32 are completely sealed to prevent any loss of water or steam, the temperatures of these units can be raised to and held at any desired temperature by merely controlling the on and off cycles of the heating elements 20 and 42. Since the heating elements are acting on a small volume of water in a confined space, the power required to produce these temperatures is small. By varying the number and capacity of the heating units 16 and the heating capability of vessel 32, it is possible to produce superheated steam at a rate commensurate with its use.

Steam is discharged from the boiler through steam pipe 52 (controlled by a valve, not shown) leading to the engine or turbine or other point of use.

Radiation of heat from tube 34 of vessel 32 may be increased by increasing the surface area in any conventional way as, for example, by including fins on the exterior.

As previously noted, raising the temperature of the saturated steam in the boiler to create superheated steam does not raise the boiler pressure. Hence, the presence of superheated steam does not create any unanticipated pressure condition above the known capacity of the boiler. On the other hand, the pressure and temperature of the saturated steam in the vessel 32 will be much higher than that of the boiler steam so the walls of vessel 32 must be carefully designed to cope with the high pressure therein.

DESCRIPTION OF A MODIFIED EMBODIMENT

Figure 4:
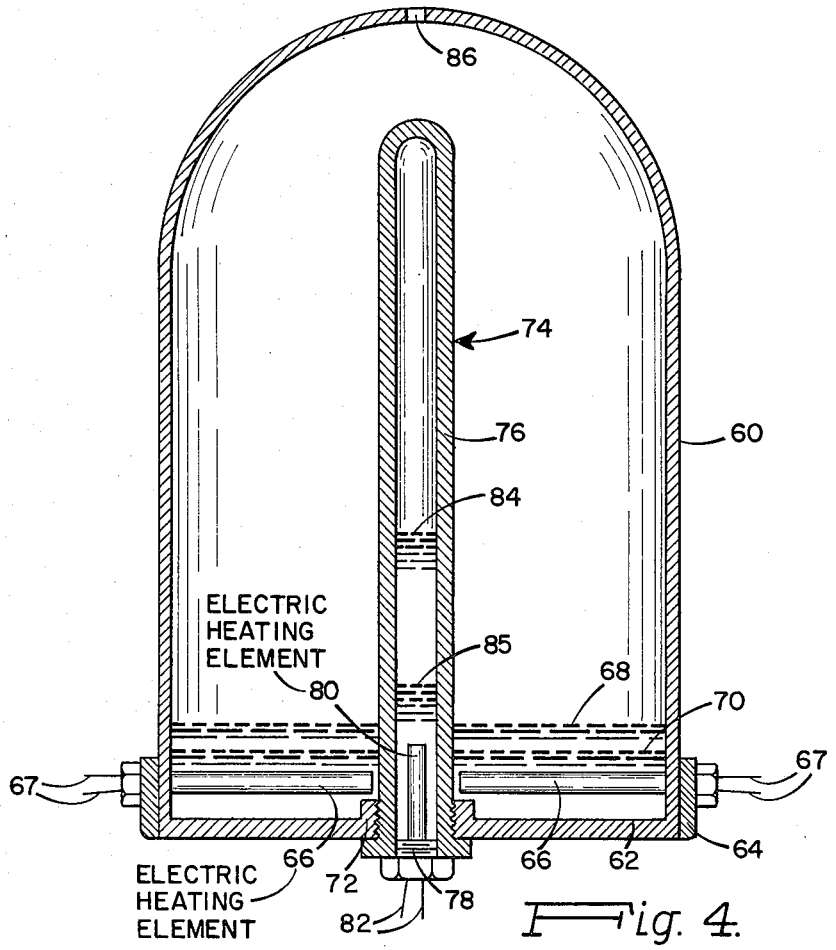
FIG. 4 is a vertical section of another form of the invention.

The construction shown in FIG. 4 is a somewhat simplified version of the construction of FIGS. 1, 2 and 3.

The upper body 60 of the boiler is secured to a base 62 within the circular flange 64.

A plurality of electric heating elements 66 fed by wires 67 extend radially inward through the flange and boiler wall to lie horizontally close to the bottom in boiler water having high and low levels suggested at 68 and 70 and maintained by automatic feed water controls.

Heating elements 66 are adequate to create saturated steam in the boiler to the desired pressure and to maintain that pressure by on and off operation under temperature and/or pressure controls in the boiler.

In the base 62 is a threaded central opening 72 into which is screwed in water tight relation a sealed pressure vessel 74 comprising a strong tube 76 closed at its upper end and closed at the lower end by a threaded plug 78 which carries an electric heating element 80 fed by wires 82.

Prior to insertion of vessel 74 into opening 72, plug 78 is removed and, with the vessel upside down, a measured quantity of water is poured in and plug 78 then replaced. With the unit in place in the boiler, the cold water level will be, for example, at 84. With the element 80 in operation, the tube will fill with saturated steam with the water level dropping to a lower level as at 85 in accord with the temperature and pressure.

When the boiler is in operation, elements 66 will create saturated steam which will be further heated by radiation from the high temperature tube 76 to raise the steam to superheated condition. The superheated steam may be stored in the boiler by appropriate on and off cycles of elements 66 and 80 under pressure and temperature controls. On the other hand the heat output of vessel 74 is adequate to create superheated steam continuously as it may be fed through valved outlet 86 to the point of use.

From the above description it can be seen that the principles of operation in this construction of FIG. 4 are the same as those of the construction of FIGS. 1, 2 and 3.

Figure 5:
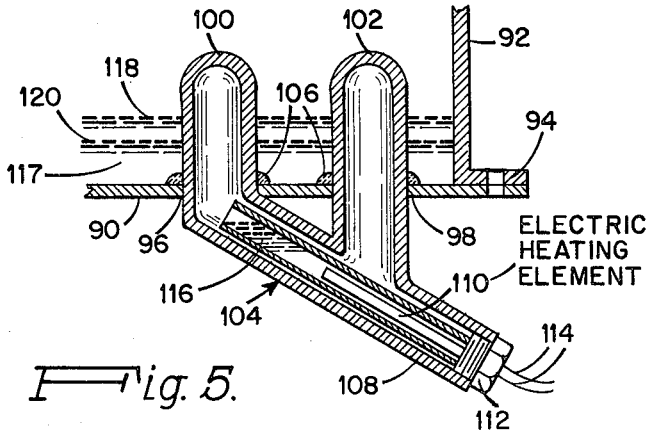
FIG. 5 shows a modified form of steam generating unit.

A modification of the boiler water heating units is shown in FIG. 5. Instead of having an electrical heating element for each sealed steam generating tube, a single heating element generates steam to heat two tubes.

In FIG. 5, the bottom of the boiler is indicated at 90 to which the boiler shell 92 is bolted by flange 94. The bottom 90 has holes therethrough as at 96 and 98 to receive the upstanding tubes 100 and 102 of a steam generating unit 104. The tube may be secured to the bottom in any convenient water tight manner as by welding, for example, as at 106.

The downwardly sloping underbody 108 contains an electrical heating element 110 carried by a screw threaded plug 112 and fed by current carrying wires 114.

The plug 112 also has a water sleeve 116 mounted thereon, the sleeve being open at its upper end and fitting loosely within body 108. The sleeve is filled with water prior to placing it along with element 110 in body 108 and screwing the plug 112 into sealed position. The water in sleeve 116 is sufficient to supply saturated steam to both tubes 100 and 102 when the element 110 is in operation. The temperature of tubes 100 and 102 will be high enough to generate steam from water 117 at the desired pressure.

High and lower boiler water levels indicated at 118 and 120 are maintained by conventional automatic feed water controls.

The boiler bottom will have mounted therein a sufficient number of units 104 to generate steam in the boiler 102 at the desired rate for conversion to superheated steam by a superheated mounted in the bottom 90, similar to the superheater 32 shown in FIG. 1.

It is intended to cover all changes and modifications of the example of the invention herein chosen for purposes of the disclosure which do not constitute departures from the spirit and scope of the invention.

I claim:

1. Means for producing superheated steam, said means comprising a steam boiler having a bottom wall and a steam outlet, means for maintaining a controlled depth and volume of water in said boiler, electrically energized means for heating the said boiler water to produce saturated steam in said boiler at any desired temperature and pressure, said boiler water heating means being in the form of at least one sealed high pressure tube, each tube having therein an electrically energized heating element and a limited quantity of water whereby high pressure high temperature saturated steam will be produced in the tube upon energization of said heating element, each of said at least one sealed high pressure tube residing in a boiler wate filled well extending through and below the bottom wall of said boiler, the vertical dimension of the heat transferring surface of each of said at least one tube being substantially greater than the said controlled depth of the boiler water, electrically operated superheating means fixed within said boiler for raising the temperature of said saturated steam to a superheated temperature, said superheating means comprising a sealed high pressure vessel in the form of a vertical tube having therein a limited quantity of water and an electrically energized heating element disposed in said water for generating saturated steam in said vessel at a temperature well above the temperature of the saturated steam in said boiler, said vessel mounted on the bottom wall of said boiler and extending upward in the boiler space above said boiler water and said boiler water heating means.

2. The construction set forth in claim 1, the electrically energized heating element disposed in each high pressure tube being carried by means removable from the bottom of the tube, each of said removable means carrying a sleeve fixed thereto and surrounding the said heating element, each sleeve being closed at its lower end whereby a limited quantity of water placed in said sleeve may be introduced into the high pressure tube when the said removable means is installed in the tube.

3. The construction set forth in claim 2, the said vessel heating element being carried by means removable from the bottom of said vessel, said vessel heating element being surrounded by a sleeve fixed with respect thereto and closed at its lower end whereby a limited quantity of water placed in said sleeve may be introduced into said vessel when said vessel heating element is installed in said vessel.

* * * * *